US010392176B1

(12) United States Patent
Hu

(10) Patent No.: US 10,392,176 B1
(45) Date of Patent: Aug. 27, 2019

(54) BUFFER STRUCTURE AND PACKAGING BOX

(71) Applicants: HKC Corporation Limited, Shenzhen, Guangdong (CN); CHONGQING HKC OPTOELECTRONICS TECHNOLOGY CO., LTD., Chongqing (CN)

(72) Inventor: Xiaogang Hu, Guangdong (CN)

(73) Assignees: HKC Corporation Limited, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 16/278,102

(22) Filed: Feb. 17, 2019

Related U.S. Application Data

(63) Continuation of application No. PCT/CN2018/122008, filed on Dec. 19, 2018.

(30) Foreign Application Priority Data

Dec. 4, 2018 (CN) ..... 2018 2 2027457 U

(51) Int. Cl.
*B65D 81/05* (2006.01)
*B65D 85/68* (2006.01)

(52) U.S. Cl.
CPC ..... *B65D 81/058* (2013.01); *B65D 85/68* (2013.01); *B65D 2585/6835* (2013.01)

(58) Field of Classification Search
USPC ..... 206/586, 591, 592, 594, 453, 454, 722, 206/701
See application file for complete search history.

(56) References Cited

U.S. PATENT DOCUMENTS 8,777,007 B2 * 7/2014 Chen ..... B65D 81/05 206/454
8,789,698 B2 * 7/2014 Kuo ..... B65D 81/107 206/449
9,010,534 B2 * 4/2015 Kuo ..... B65D 81/05 206/454
9,038,824 B2 * 5/2015 Zhao ..... B65D 81/02 206/453
2007/0205117 A1 * 9/2007 Kong ..... B65D 81/113 206/96
2012/0031807 A1 * 2/2012 Shimomichi ..... B65D 81/057 206/586

(Continued)

*Primary Examiner* — Jacob K Ackun

(57) ABSTRACT

The present disclosure provides a buffer structure and a packaging box, the buffer structure includes a fixing frame and at least one adjusting component, the adjusting component includes at least one adjusting rod, a first locking member, and a second locking member, the adjusting rod passes through the adjusting hole along the extending direction of the adjusting rod, and includes a plurality of connecting parts arranged in parallel along the extending direction, the first locking member and the second locking member are respectively connected to one of connecting parts and clamp the supporting plate; and a buffer member connected to an end face of the adjusting rod and located on a side of the second locking member away from the supporting plate.

20 Claims, 6 Drawing Sheets

(56) References Cited

U.S. PATENT DOCUMENTS

| | | | | |
|---|---|---|---|---|
| 2013/0306514 | A1* | 11/2013 | Hu | B65D 81/053<br>206/586 |
| 2014/0083898 | A1* | 3/2014 | Chen | B65D 11/10<br>206/523 |
| 2014/0097121 | A1* | 4/2014 | Chen | B65D 85/48<br>206/586 |
| 2014/0166522 | A1* | 6/2014 | Kuo | B65D 85/30<br>206/454 |
| 2017/0144826 | A1* | 5/2017 | Cheng | B65D 25/10 |

* cited by examiner

BUFFER STRUCTURE AND PACKAGING BOX

CROSS-REFERENCE TO RELATED APPLICATIONS

The present application is a Continuation Application of International Application No. PCT/CN2018/122008, filed Dec. 19, 2018, which claims the benefit of China Patent Application No. CN201822027457.8, filed Dec. 4, 2018, with the State Intellectual Property Office and entitled "Buffer Structure and Packaging Box", the entirety of which is hereby incorporated herein by reference.

TECHNICAL FIELD

The present disclosure generally relates to the technical field of packaging, and more particularly relates to a buffer structure, and a packaging box using the buffer structure.

BACKGROUND

The statements herein merely provide background information related to the present disclosure and do not necessarily constitute prior art. Display panels are usually packaged and transported in specific boxes. A buffer structure with a fixed size is usually mounted in the packaging box for edges of the display panel to buffer, to prevent the display panel from directly contacting the packaging box to cause abrasion. However, the space between the display panels and the buffer structure may become larger or smaller due to the size difference of the packaging box or the packaging box with the same size used for packing display panels with different sizes. If the space between the display panel and the buffer structure is large, the display panel may shake in the packaging box during transportation, resulting in wear and tear of the display panel. If the space between the display panel and the buffer structure is small, the display panel may be subject to a large pressing force and may be damaged during transportation.

SUMMARY

It is therefore one main object of the disclosure to provide a buffer structure, which aims to provide an appropriate matching gap between the display panel and the packaging box, so that the display panel would not be prone to be damaged during packaging and transportation.

In order to realize the above aim, the buffer structure provided by the present disclosure is applied to a packaging box of a display panel, the packaging box includes a box body, the buffer structure includes:

a fixing frame, the fixing frame includes at least one mounting plate and at least one supporting plate, the mounting plate connects to the box body, and the supporting plate defines an adjusting hole;

at least one adjusting component, the adjusting component includes at least one adjusting rod, at least one first locking member, and at least one second locking member, the adjusting rod passes through the adjusting hole along the extending direction of the adjusting rod, and includes a connecting part consistent with the extending direction, the first locking member and the second locking member connect to the connecting part at two sides of the supporting plate, and clamp the supporting plate; and a buffer member, connected to an end face of the adjusting rod, and located at a side of the second locking member away from the supporting plate, adjusting joint positions of the first locking member and the second locking member on the connecting part to change a space between the supporting plate and the buffer member.

Electively, the connection part includes a plurality of continuous joint positions.

Electively, the connecting part includes an external thread defined outside the adjusting member, the first locking member and the second locking member are nut having internal thread, and the internal threads match and connect with the external thread.

Electively, the connecting part includes a plurality of clamping positions spaced from each other, the first locking member and the second locking member are both buckle, and each of the buckles is clamped with one of the clamping positions.

Electively, the buffer member includes a connecting plate and a buffer plate, the connecting plate connects to the end face of the adjusting rod, and the buffer plate connects to a surface of the connecting plate away from the adjusting rod.

Electively, the connecting plate and the buffer plate are of an integral structure.

Electively, the buffer structure includes a plurality of adjusting rods, the supporting plate has a plurality of adjusting holes, one end of each adjusting rod connects to the buffer member, and the other end of each adjusting rod correspondingly passes through one of the adjusting holes.

Electively, the plurality of adjusting rods are arranged side by side.

Electively, the supporting plate defines a limit groove, the adjusting hole is defined in a bottom wall of the limit groove, and the buffer member matches with the limit groove in size.

Electively, the fixing structure includes two supporting plates cooperatively forming an angle, the buffer structure includes two adjusting members and two buffer members, one supporting plate, one adjusting member, and one buffer member are cooperatively mounted together, and the two buffer members both face a display panel in the box body.

Electively, the fixing structure includes two mounting plates, each of the mounting plates is defined at an extension line of the supporting plate.

Electively, an edge of the mounting plate away from the supporting plate bends and extends sideways.

Electively, the two supporting plates are perpendicular to each other.

Electively, the buffer member is made of a flexible material.

The present disclosure provides a buffer structure applied to a packaging box of display panel, the packaging box includes a box body, the buffer structure includes:

a fixing frame, the fixing frame includes two mounting plates and two supporting plates, the two mounting plates are perpendicular to each other, and both located at an extension line of one of the supporting plates, the two mounting plates connect to the box body, and each supporting plate defines a plurality of adjusting holes;

two adjusting components, one adjusting component correspondingly connects to one of the supporting plates, the adjusting member includes a plurality of adjusting rods, a plurality of first locking members, and a plurality of second locking members, each of the adjusting rods passes through one adjusting hole along the extending direction of the adjusting rod, and each of the adjusting rods includes an external thread consistent with the extending direction, the first locking members and the second locking members all includes an internal thread, and one of the first locking members and one of the second locking members connect to one of the adjusting rods through threads at two sides of the supporting plate, and clamp the supporting plate; and two buffer members, one buffer member connects to one corresponding adjusting component, the buffer members connect to an end of each of the adjusting rods, and is located at a side of the second locking member away from the supporting plate, adjusting joint positions of the first locking member and the second locking member at the connecting part to change a space between the supporting plate and the buffer member.

The present disclosure further provides a packaging box, the packaging box includes a box body and a buffer structure, the packaging box includes an inserting groove matching with the mounting plate, the mounting plate is mounted in the inserting groove;

the buffer structure includes:

a fixing frame, the fixing frame includes at least one mounting plate and at least one supporting plate, the mounting plate connects to the box body, and the supporting plate defines an adjusting hole;

at least one adjusting component, the adjusting component includes at least one adjusting rod, at least one first locking member, and at least one second locking member, the adjusting rod passes through the adjusting hole along the extending direction of the adjusting rod, and includes a connecting part consistent with the extending direction, the first locking member and the second locking member connect to the connecting part at two sides of the supporting plate, and clamp the supporting plate; and a buffer member, connected to an end face of the adjusting rod, and located at a side of the second locking member away from the supporting plate, adjusting joint positions of the first locking member and the second locking member on the connecting part to change a space between the supporting plate and the buffer member.

In the technical solution of the present disclosure, the buffer structure includes the fixing frame, the adjusting component and the buffer member, the fixing frame includes the mounting plate arranged to be connected with the box body and the supporting plate arranged to support the buffer member, and the adjusting component is connected with the supporting plate and the buffer member. In the process of transporting or handling the packaging box, the display panel in the packaging box can directly contact the buffer member, the buffer member can buffer the display panel in a certain extent, thus reducing the impact force on the display panel.

The supporting plate also includes the adjusting hole, the adjusting rod passes through the adjusting hole, and the first locking member and the second locking member are respectively connected to the connecting parts at two sides of the supporting plate to clamp the supporting plate and prevent the adjusting rod from moving relative to the supporting plate. By adjusting the different positions where the first locking member and the second locking member are connected to the connecting part, the space between the buffer member and the surface of the display panel is increased or decreased, so that the buffering structure can be appropriately arranged to package different display panels, the matching gap between the display panel and the packaging box is appropriate, and the display panel is not prone to damage during packaging and transportation.

BRIEF DESCRIPTION OF THE DRAWINGS

To better illustrate the technical solutions that are reflected in various embodiments according to this disclosure or that are found in the prior art, the accompanying drawings intended for the description of some embodiments herein or for the prior art may now be briefly described, it is evident that the accompanying drawings listed in the following description show merely some embodiments according to this disclosure, and that those having ordinary skill in the art may be able to obtain other drawings based on the arrangements shown in these drawings without making inventive efforts.

Figure 1:
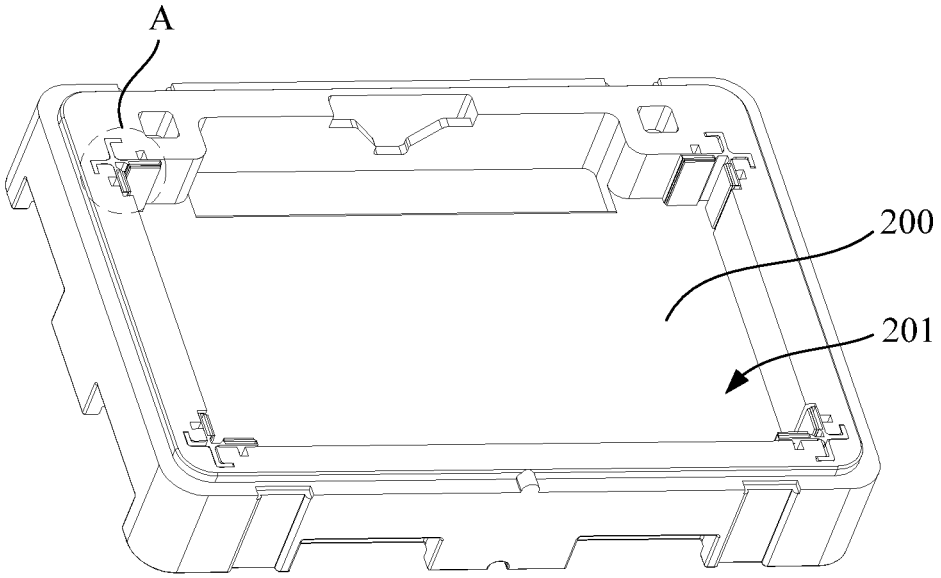
FIG. 1 is a structural diagram of the packaging box of the present disclosure according to some embodiments.
Figure 2:
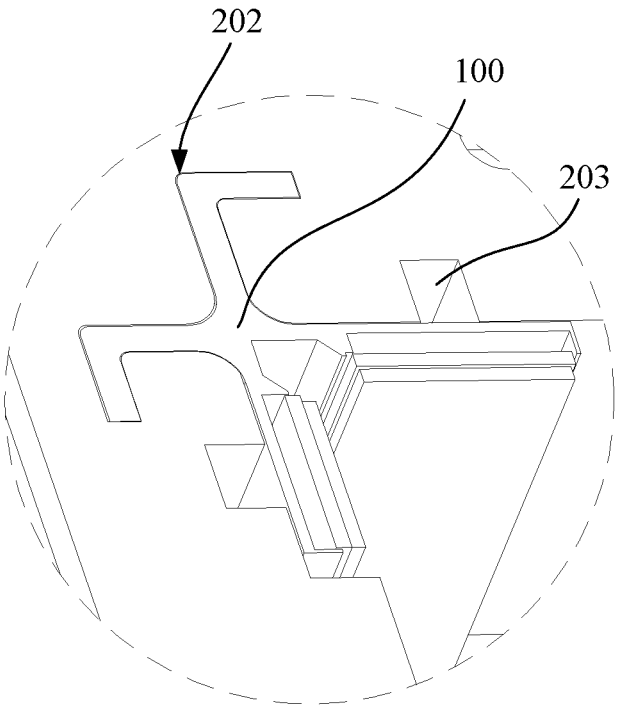
FIG. 2 is an enlarged diagram of portion A shown in FIG. 1.
Figure 3:
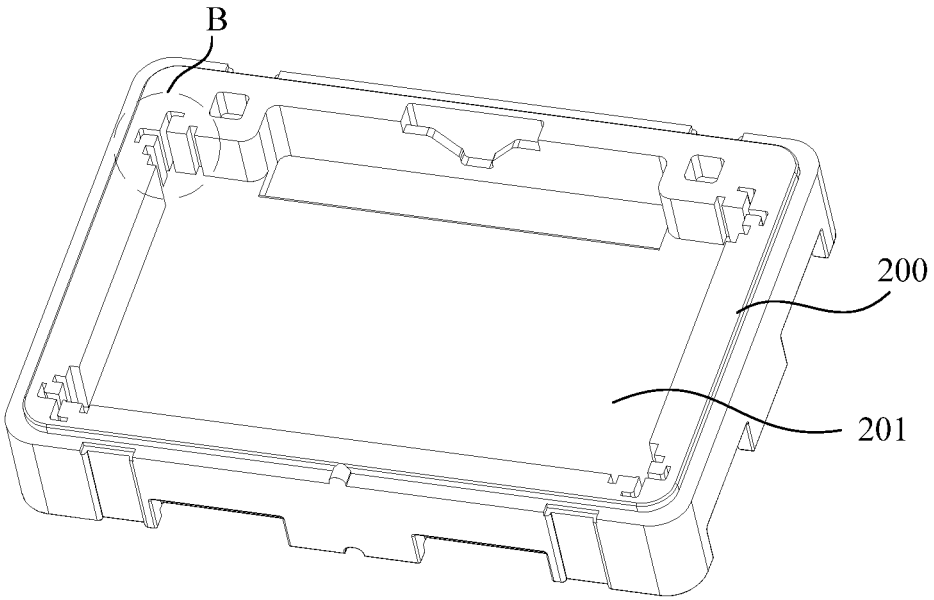
FIG. 3 is a structural diagram of the box body of the packaging box shown in FIG. 1.

The realization of the aim, functional characteristics, advantages of the present disclosure are further described specifically with reference to the accompanying drawings and embodiments.

DETAILED DESCRIPTION

The technical solutions of some embodiments of the present disclosure may be clearly and completely described in the following with reference to the accompanying drawings. It is obvious that some embodiments to be described are only a part rather than all of some embodiments of the present disclosure. All other embodiments obtained by persons skilled in the art based on some embodiments of the present disclosure without creative efforts shall fall within the protection scope of the present disclosure.

It is to be understood that, all of the directional instructions in the exemplary embodiments of the present disclosure (such as top, down, left, right, front, back . . . ) can only be used for explaining relative position relations, moving condition of the elements under a special form (referring to figures), and so on, if the special form changes, the directional instructions changes accordingly.

In addition, the descriptions, such as the "first", the "second" in the exemplary embodiment of present disclosure, can only be used for describing the aim of description, and cannot be understood as indicating or suggesting relative importance or impliedly indicating the number of the indicated technical character. Therefore, the character indicated by the "first", the "second" can express or impliedly include at least one character. In addition, the technical proposal of each exemplary embodiment can be combined with each other, however the technical proposal must base on that the ordinary skill in that art can realize the technical proposal, when the combination of the technical proposals occurs contradiction or cannot realize, it should consider that the combination of the technical proposals does not existed, and is not contained in the protection scope required by the present disclosure.

The present disclosure provides a buffer structure 100, which can be used not only for packaging and transporting display panels, but also for buffering and packaging precision instruments, instruments, precious instruments, household appliances, glass and ceramic products, handicrafts, valuables, high-grade handicrafts and the like.

In some embodiments, the buffer structure 100 is optionally provided as a packaging box for the display panel, and the packaging box for the display panel is configured to package the display panel. The display panel may be a twisted nematic (TN) type panel, a vertical alignment (VA) panel, an in-plane switching (IPS) panel, a continuous pinwheel alignment (CPA) panel, an advanced super dimension switch (ADSDS) based panel, and the like.

It may be understood that the display panel may be a liquid crystal panel which connects to the circuit board through a chip on flex, or, a chip on film (COF), and arranged to realize signal transmission. The liquid crystal panel is prone to break when impacted or vibrated by an external force, resulting in scrapping, so it is especially necessary to prevent the liquid crystal panel from being damaged during its transportation.

Referring to FIGS. 1 to 6, in some embodiments of the present disclosure, the buffer structure 100 should be defined as a packaging box, and the packaging box includes a box body 200, and the buffer structure 100 includes:

a fixing frame 10, which includes at least one mounting plate 11 and at least one supporting plate 13, the mounting plate 11 connects to the box body 200, and the supporting plate 13 defines an adjusting hole 131;

at least one adjusting component 30 which includes at least one adjusting rod 31, at least one first locking member 33, and at least one second locking member 35, the adjusting rod 31 passes through the adjusting hole 131 along the extending direction of the adjusting rod 31 and includes a connecting part 311 consistent with the extending direction, the first locking member 33 and the second locking member 35 connect to the connecting parts 311 at two sides of the supporting plate 13 and clamp the supporting plate 13; and a buffer member 50, connected to an end face of the adjusting rod 31, and located at a side of the second locking member 35 away from the supporting plate 13, adjusting joint positions of the first locking member 33 and the second locking member 35 on the connecting part 311 to change a space between the supporting plate 13 and the buffer member 50.

In the technical solution of the present disclosure, the buffer structure 100 includes the fixing frame 10, the adjusting component 30, and the buffer member 50, the fixing frame 10 includes the mounting plate 11 arranged to be connected with the box body 200 and the supporting plate 13 arranged to support the buffer member 50, and the adjusting rod 31 is connected with the supporting plate 13 and the buffer member 50. In the process of transporting or handling the packaging box, the display panel in the packaging box can directly contact the buffer member 50, the buffer member 50 can buffer the display panel in a certain extent, thus reducing the impact force on the display panel.

In some embodiments of the present disclosure, the supporting plate 13 also has an adjustment hole 131 through which the adjustment rod 31 passes. The first locking member 33 and the second locking member 35 connected to the connecting parts 311 at two sides of the supporting plate 13 to clamp the supporting plate 13 and prevent the adjustment rod 31 from moving relative to the supporting plate 13. By adjusting the different positions where the first locking member 33 and the second locking member 35 are connected to the connecting part 311, the space between the buffer member 50 and the supporting plate 13 is adjusted, so that the space between the buffer member 50 and the surface of the display panel is increased or decreased, so that the buffering structure 100 can be appropriately arranged to package different display panels, and the matching gap between the display panel and the packaging box is appropriate, so that the display panel is not easily damaged during packaging and transportation.

The fixing frame 10 is made of acrylonitrile-butadiene-styrene plastic (ABS), polyethylene (PE), polypropylene (PP) and other materials. Of course, the fixing frame 10 includes but is not limited to ABS, PE, PP and other materials, and which is not limited here. The buffer member 50 is made of silica gel, foam or other elastic material, and which is not limited here.

In some embodiments of the present disclosure, the connection part 311 may a plurality of continuous joint positions, or may include a plurality of joint positions that are spaced from each other. When the plurality of joint positions are continuously arranged, the first locking member 33 and the second locking member 35 can be continuously adjusted on the adjusting rod 31, so that the space between the supporting plate 13 and the buffer member 50 can be continuously adjusted. When the plurality of joint positions are spaced from each other, the space between the supporting plate 13 and the buffer member 50 can be selected from several fixed values and is limited by the number of joint positions.

Figure 5:
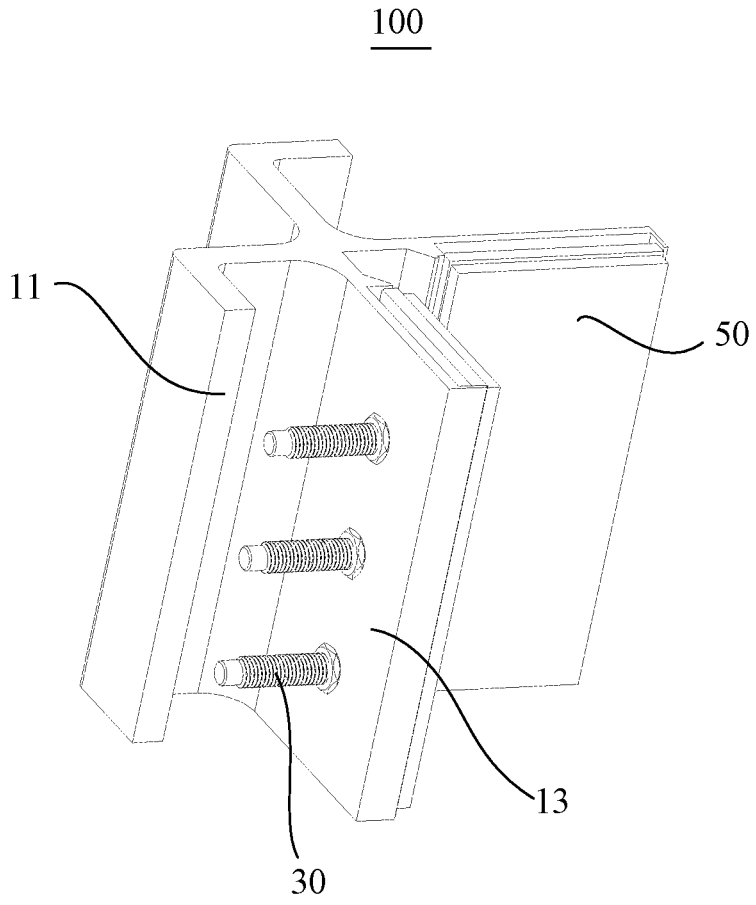
FIG. 5 is a structural diagram of the buffer structure of the present disclosure according to some embodiments.
Figure 6:
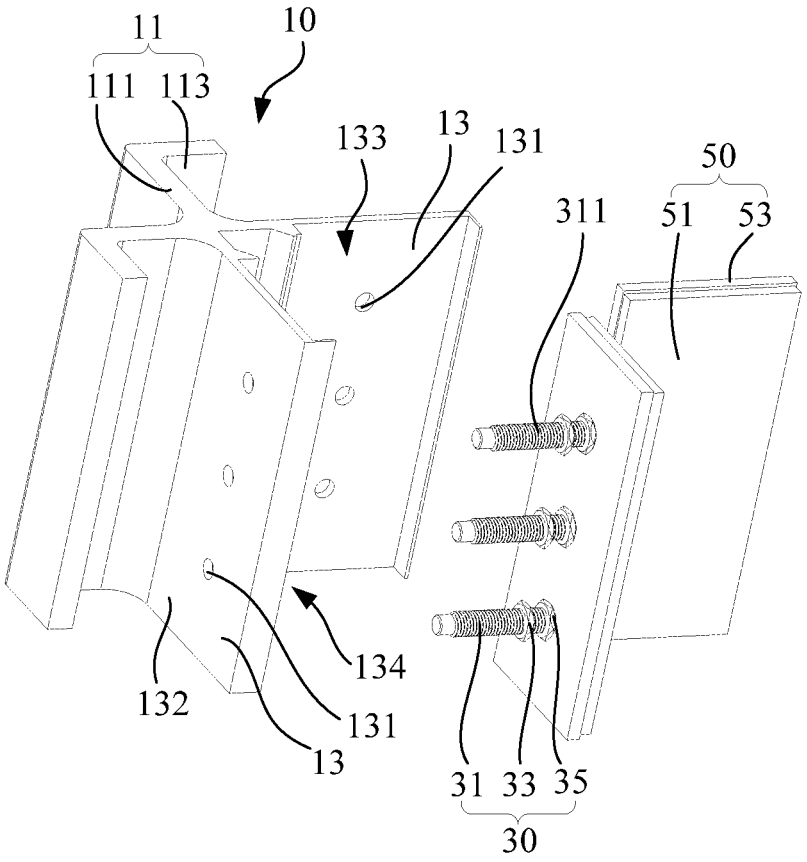
FIG. 6 is a partially exploded diagram of the buffer structure shown in FIG. 5.

Electively, in conjunction with FIGS. 5 and 6, the connecting part 311 includes a plurality of joint positions arranged continuously, the connecting part 311 includes an external thread provided on the outer surface of the adjusting member, and the first locking member 33 and the second locking member 35 are both nut having an internal thread, the internal threads match and connect with the external thread.

The first locking member 33 and the second locking member 35 can be adjusted simultaneously to change the space between the supporting plate 13 and the buffer member 50, thereby keeping the gap between the display panel and the buffer structure 100 within a reasonable range and further preventing the display panel from being damaged during transportation.

The supporting plate 13 has a first surface 132 and a second surface 134 arranged opposite to each other. After the buffer structure 100 is installed in the box body 200, the display panel is placed inside the box body 200 in a matching manner. The first surface 132 of the supporting plate 13 faces the inner surface of the box body 200 and the second surface 134 faces the surface of the display panel. The first locking member 33 abuts against the first surface 132, and the second locking member 35 is located between the second surface 134 and the buffer member 50 and abuts against the second surface 134.

In some embodiments of the present disclosure, the connecting part 311 includes a plurality of clamping positions spaced from each other, the first locking member 33 and the second locking member 35 are both buckle, and each buckle is clamped in one clamping position in the matching manner. In some embodiments, both the first locking member 33 and the second locking member 35 can be connected with one corresponding locking position. When it is necessary to adjust the space between the supporting plate 13 and the buffer member 50, the first locking member 33 and the second locking member 35 are detached from the adjusting rod 31, and the inserting degree of the adjusting rod 31 in the adjusting hole 131 is adjusted to ensure that the space between the supporting plate 13 and the buffer member 50 reaches a proper range, and then the first locking member 33 and the second locking member 35 are clamped in the corresponding locking position.

It can be understood that the first locking member 33 and the second locking member 35 can also have a clamping structure. The first locking member 33 and the second locking member 35 can be clamped at any positions of the adjusting rod 31, and the purpose of adjusting the space between the supporting plate 13 and the buffer member 50 can also be achieved. In some embodiments, the outer surface of the adjusting rod 31 defines the connecting parts 311 arranged continuously.

Referring to FIG. 6, the buffer member 50 includes a connecting plate 53 and a buffer plate 51, the connecting plate 53 is connected to the end face of the adjusting rod 31, and the buffer plate 51 is connected to the surface of the connecting plate 53 away from the adjusting rod 31. In some embodiments, the connecting plate 53 is made of hard material, while the buffer plate 51 is made of flexible material, and the buffer plate 51 faces the display panel to buffer the movement of the display panel. The connecting plate 53 connects the adjusting rod 31 and can transmit the force of the buffer plate 51 to the adjusting rod 31 and further to the supporting plate 13. In some embodiments, the connecting plate 53 and the adjusting rod 31 may be of an integral structure for installation operation. The plate-shaped buffer plate 51 and the connecting plate 53 can increase the contact area between the display panel and the buffer plate 51, thereby dispersing the force of the display surface hitting the buffer plate 51, and thus better protecting the display panel from damage. The adjusting rod 31 has a columnar shape, and the cross section of the adjusting rod 31 may be circular or polygonal.

In some embodiments of the present disclosure, the buffer structure 100 includes a plurality of adjusting rods 31, and the supporting plate 13 includes a plurality of adjusting holes 131. One end of each adjusting rod 31 all connects to the buffer member 50, and the other end of each adjusting rod 31 passes through one corresponding adjusting hole 131.

In some embodiments, the plurality of adjustment rods 31 are spaced from each other, and the extension lengths of the plurality of adjustment rods 31 are the same and can be adjusted synchronously. The plurality of adjusting rods 31 can make the support of the adjusting component 30 to the buffer plate 51 more uniform and stable, and the force of the display panel to the buffer structure 100 is more uniform, so that the reaction force of the buffer structure 100 to the display panel is more uniform and stable.

Figure 4:
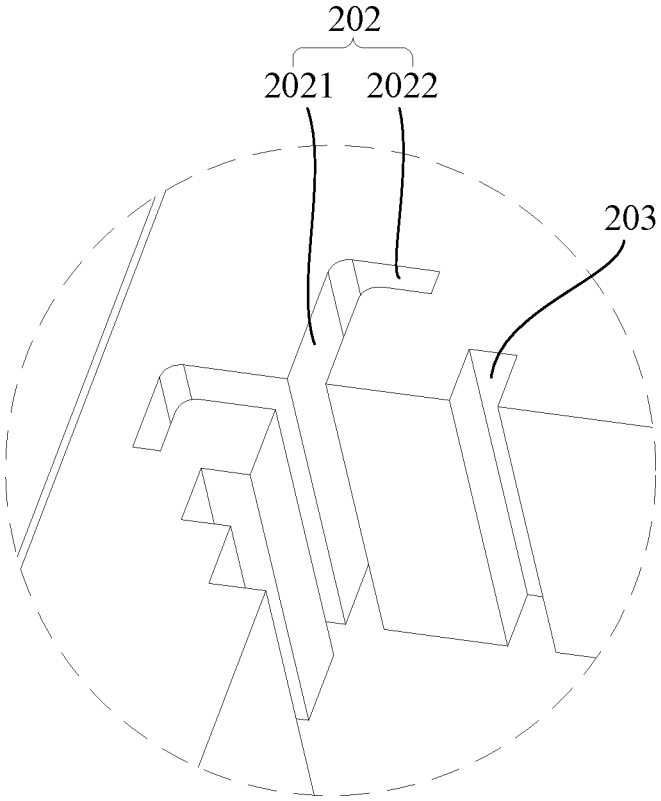
FIG. 4 is an enlarged diagram of portion B shown in FIG. 3.

Referring to FIG. 4, the plurality of adjusting rods 31 are arranged side by side, the connecting plate 53 has a long side with a long dimension and a short side with a short dimension, and the plurality of adjusting rods 31 are arranged side by side along the extending direction of the long side. In some embodiments, the connecting plate 53 has two opposite long sides and two opposite short sides, and the arrangement directions of the plurality of adjusting rods 31 coincide with the extension directions of the long sides, so that the connecting plate 53 is more stably supported along the direction of its larger size. It may be understood that the connecting plate 53 may have other shapes such as trapezoid, triangle or circle, etc., and the arrangement directions of the plurality of adjusting rods 31 are the same as the directions of the portion of the connecting plate 53 having a larger size. If the connecting plate 53 has the same size in all directions, for example, the connecting plate 53 is circular, the arrangement direction of the adjusting rods 31 is any direction passing through the center of the circle.

Furthermore, the supporting plate 13 defines a limit groove 133, the adjustment hole 131 is formed in the bottom wall of the limit groove 133, and the buffer member 50 matches with the limit groove 133 in size.

In some embodiments, when the space between the connecting plate 53 and the supporting plate 13 is close enough, the movement of the buffer member 50 is limited by the limit groove 133, so that the buffer member 50 can move more smoothly when it is acted on by the display panel, and thus the buffer force applied to the display panel is more gentle.

In some embodiments of the present disclosure, the fixing structure has two supporting plates 13 cooperatively form an angle, and the buffer structure 100 includes two adjusting component 30 and two buffer members 50. One supporting plate 13, one adjusting component 30, and one buffer member 50 are cooperatively mounted together, and the two buffer members 50 both face the display panel in the box body 200.

In some embodiments, the buffer structure 100 includes two supporting plates 13 cooperatively form an angle, each supporting plate 13 supports a corresponding buffer member 50 through one adjusting component 30, and if an angle is defined between the two supporting plates 13, there is also an angle defined between the two buffer members 50, and the two buffer members 50 stop and buffer the corner of the display panel in the box body 200.

Furthermore, the fixing frame 10 includes two mounting plates 11, each of the two mounting plates 11 is located on an extension line of one supporting plate 13. An angle is defined between the two mounting plates 11. After the mounting plates 11 are connected to the box body 200, the two mounting plates 11 cooperatively forming an angle limit the fall-off of the buffer structure 100 from two directions, so that the connection between the buffer structure 100 and the box body 200 is more stable.

Electively, the two supporting plates 13 are perpendicular to each other, and the two mounting plates 11 are also perpendicular to each other, and the fixing structure is generally cross shaped.

Furthermore, the edge of the mounting plate 11 away from the supporting plate 13 bends and extends sideways. The bending and extending structure of the mounting plate 11 can further increase the structural strength of the fixing frame 10, and the bending portion can further prevent the buffer structure 100 from falling off. The mounting plate 11 includes a first side plate 111 and a second side plate 113, the first side plate 111 connects to one supporting plate 13 and extends toward the extension line of the supporting plate 13, and the second side plate 113 connects to the side of the first side plate 111 away from the supporting plate 13, and extends toward the lateral direction of the second side plate 113. The second side plates 113 of the two mounting plates 11 extend in opposite directions respectively.

In some embodiments of the present disclosure, the buffer structure 100 should be mainly set at the corner position in the box body 200 of the packaging box, so as to prevent the four corners of the display panel from colliding with the buffer structure 100 at a short distance from the front, thus playing a better role in protecting the display panel, and adjusting the adjusting component 30, thus ensuring that the space between the display panel and the buffer structure 100 is maintained within a safe range.

The present disclosure also provides a packaging box, which includes a box body 200 and a buffer structure 100. The specific structure of the buffer structure 100 refers to the above embodiments. As the packaging box adopts all the technical proposals of the above exemplary embodiments, the packaging box at least has all of the beneficial effects of the technical proposals of the above exemplary embodiments, no need to repeat again. The packaging box includes an inserting groove 202 matched with the mounting plate 53, and the mounting plate 53 is mounted in the inserting groove 202 in the matching manner.

Referring to FIG. 4, the inner surface of the box body 200 defines the inserting groove 202 into which the connecting plate 53 is inserted, the supporting plate 13 connects to the connecting plate 53 and extends into an accommodating cavity 201, and the inner surface of the package box is also provided with an adapting groove 203 in which the first locking member 33 and a part of the adjusting rods 31 are received, so that the first surface 132 of the supporting plate 13 can be fitted to the inner surface of the package box. When the buffer member 50 receives the force of the display panel, the force is transmitted to the supporting plate 13 through the adjusting component 30 and then transmitted to the box body 200, thereby protecting the buffer structure 100 and preventing the buffer structure 100 from being damaged.

Furthermore, the inserting groove 202 includes a first inserting section 2021 and a second inserting section 2022 that communicate with each other. The first side plate 111 of the mounting plate 11 is inserted into the first inserting section 2021, and the second side plate 113 of the mounting plate 11 is inserted into the second inserting section 2022. In some embodiments, each second side plate 113 is respectively parallel to one corresponding supporting plate 13. After the buffer structure 100 is installed in the box body 200, the force applied to the buffer member 50 is transmitted to the supporting plate 13 through the adjusting component 30, and the inner side surface of the box body 200 supports the supporting plate 13. At the same time, the inner wall of the second inserting section also supports the second side plate 113, further ensuring the uniform force applied to the buffer structure 100 and preventing the buffer structure 100 from being damaged.

The foregoing description merely depicts some embodiments of the present disclosure and therefore is not intended to limit the scope of the present disclosure. An equivalent structural or flow changes made by using the content of the specification and drawings of the present disclosure, or any direct or indirect present disclosures of the disclosure on any other related fields shall all fall in the scope of the present disclosure.

What is claimed is:

1. A buffer structure, applied to a packaging box of a display panel, the packaging box comprising a box body, wherein the buffer structure comprises:

a fixing frame, the fixing frame comprises at least one mounting plate and at least one supporting plate, the mounting plate connects to the box body, and the supporting plate defines an adjusting hole;

at least one adjusting component, the adjusting component comprises at least one adjusting rod, at least one first locking member, and at least one second locking member, the adjusting rod passes through the adjusting hole along the extending direction of the adjusting rod, and comprises a connecting part consistent with the extending direction, the first locking member and the second locking member connect to the connecting part at two sides of the supporting plate, and clamp the supporting plate; and a buffer member, connected to an end face of the adjusting rod, and located at a side of the second locking member away from the supporting plate, adjusting joint positions of the first locking member and the second locking member on the connecting part to change a space between the supporting plate and the buffer member.

2. The buffer structure according to claim 1, wherein the connection part comprises a plurality of continuous joint positions.

3. The buffer structure according to claim 2, wherein the connecting part comprises an external thread defined outside the adjusting member, the first locking member and the second locking member are nut having internal thread, and the internal threads match and connect with the external thread.

4. The buffer structure according to claim 1, wherein the connecting part comprises a plurality of clamping positions spaced from each other, the first locking member and the second locking member are both buckle, and each of the buckles is clamped with one of the clamping positions.

5. The buffer structure of claim 1, wherein the buffer member comprises a connecting plate and a buffer plate, the connecting plate connects to the end face of the adjusting rod, and the buffer plate connects to a surface of the connecting plate away from the adjusting rod.

6. The buffer structure according to claim 5, wherein the connecting plate and the buffer plate are of an integral structure.

7. The buffer structure according to claim 1, wherein the buffer structure comprises a plurality of adjusting rods, the supporting plate has a plurality of adjusting holes, one end of each adjusting rod connects to the buffer member, and the other end of each adjusting rod correspondingly passes through one of the adjusting holes.

8. The buffer structure according to claim 7, wherein the plurality of adjusting rods are arranged side by side.

9. The buffer structure according to claim 1, wherein the supporting plate defines a limit groove, the adjusting hole is defined in a bottom wall of the limit groove, and the buffer member matches with the limit groove in size.

10. The buffer structure according to claim 1, wherein the fixing structure comprises two supporting plates cooperatively forming an angle, the buffer structure comprises two adjusting members and two buffer members, one supporting plate, one adjusting member, and one buffer member are cooperatively mounted together, and the two buffer members both face a display panel in the box body.

11. The buffer structure as claimed in claim 10, wherein the fixing structure comprises two mounting plates, each of the mounting plates is defined at an extension line of the supporting plate.

12. The buffer structure as claimed in claim 11, wherein an edge of the mounting plate away from the supporting plate bends and extends sideways.

13. The buffer structure as claimed in claim 11, wherein the two supporting plates are perpendicular to each other.

14. The buffer structure of claim 1, wherein the buffer member is made of a flexible material.

15. A buffer structure, applied to a packaging box of display panel, the packaging box comprising a box body, wherein the buffer structure comprises:

a fixing frame, the fixing frame comprises two mounting plates and two supporting plates, the two mounting plates are perpendicular to each other, and both located at an extension line of one of the supporting plates, the two mounting plates connect to the box body, and each supporting plate defines a plurality of adjusting holes;

two adjusting components, one adjusting component correspondingly connects to one of the supporting plates, the adjusting member comprises a plurality of adjusting rods, a plurality of first locking members, and a plurality of second locking members, each of the adjusting rods passes through one adjusting hole along the extending direction of the adjusting rod, and each of the adjusting rods comprises an external thread consistent with the extending direction, the first locking members and the second locking members all comprises an internal thread, and one of the first locking members and one of the second locking members connect to one of the adjusting rods through threads at two sides of the supporting plate, and clamp the supporting plate; and two buffer members, one buffer member connects to one corresponding adjusting component, the buffer members connect to an end of each of the adjusting rods, and is located at a side of the second locking member away from the supporting plate, adjusting joint positions of the first locking member and the second locking member at the connecting part to change a space between the supporting plate and the buffer member.

16. A packaging box, wherein the packaging box comprises a box body and a buffer structure, the buffer structure comprises:

a fixing frame, the fixing frame comprises at least one mounting plate and at least one supporting plate, the mounting plate connects to the box body, and the supporting plate defines an adjusting hole;

at least one adjusting component, the adjusting component comprises at least one adjusting rod, at least one first locking member, and at least one second locking member, the adjusting rod passes through the adjusting hole along the extending direction of the adjusting rod, and comprises a connecting part consistent with the extending direction, the first locking member and the second locking member connect to the connecting part at two sides of the supporting plate, and clamp the supporting plate; and a buffer member, connected to an end face of the adjusting rod, and located at a side of the second locking member away from the supporting plate, adjusting joint positions of the first locking member and the second locking member on the connecting part to change a space between the supporting plate and the buffer member;

the packaging box comprises an inserting groove matched with the mounting plate, and the mounting plate is mounted in the inserting groove.

17. The packaging box according to claim 16, wherein the connection part comprises a plurality of continuous joint positions.

18. The packaging box according to claim 17, wherein the connecting part comprises an external thread defined outside the adjusting member, the first locking member and the second locking member are nut having an internal thread, and the internal threads match and connect with the external thread.

19. The packaging box according to claim 16, wherein the fixing structure comprises two supporting plates cooperatively forming an angle, the buffer structure comprises two adjusting members and two buffer members, one supporting plate, one adjusting member, and one buffer member are cooperatively mounted together, and the two buffer members both face a display panel in the box body.

20. The packaging box according to claim 19, wherein the fixing structure comprises two mounting plates, each of the mounting plates is defined at an extension line of the supporting plate.

* * * * *